United States Patent [19]

Congleton

[11] 3,933,295

[45] Jan. 20, 1976

[54] INSULATIVE PACKAGING DEVICE

[75] Inventor: Wayne L. Congleton, Whittier, Calif.

[73] Assignee: Dolco Packaging Corporation, Burbank, Calif.

[22] Filed: Jan. 17, 1974

[21] Appl. No.: 434,466

[52] U.S. Cl. ..... 229/2.5; 206/403; 206/518; 220/4 E; 229/43

[51] Int. Cl.[2] ..... B65D 43/02

[58] Field of Search ..... 206/403, 404, 518; 229/2.5, 45, 43; 220/4 E

[56] References Cited

UNITED STATES PATENTS

| | | | |
|---|---|---|---|
| 3,292,810 | 12/1966 | Schechter | 220/4 E |
| 3,346,400 | 10/1967 | Roesner | 229/2.5 |
| 3,473,649 | 10/1969 | Posso | 206/404 |
| 3,511,433 | 5/1970 | Andrews et al. | 220/4 E |
| 3,526,077 | 9/1970 | Mixon | 229/2.5 |
| 3,563,445 | 2/1971 | Clayton | 229/2.5 |
| 3,734,279 | 5/1973 | Fisher, Jr. | 229/2.5 |

*Primary Examiner*—William Price
*Assistant Examiner*—Bruce H. Bernstein
*Attorney, Agent, or Firm*—Nilsson, Robbins, Bissell, Dalcarn & Berliner

[57] ABSTRACT

A packaging device forming an insulative structure for hot food sandwiches. The packaging device includes a pair of identical members, which when interconnected, form an insulative food container. Each of the members comprise a dish-shaped portion whose periphery has a planar flange. The inner surface of the dish-shaped portion is stipled to define a plurality of protuberances interconnected by a plurality of valleys. Moisture from the food or sandwich is allowed to accumulate in the valleys, thus preventing the food and sandwiches from becoming soggy. Channels can also be formed on the planar surface for enabling moisture to escape from the packaging device. A bayonet locking arrangement for the members comprises studs formed on the planar surfaces of the members, each of the studs interacting with locking slots formed opposite the studs on the opposite planar surface of the other member. The diameter of the studs is slightly greater than the width of the slots providing a tight friction fit therebetween.

10 Claims, 7 Drawing Figures

FIG. 1.
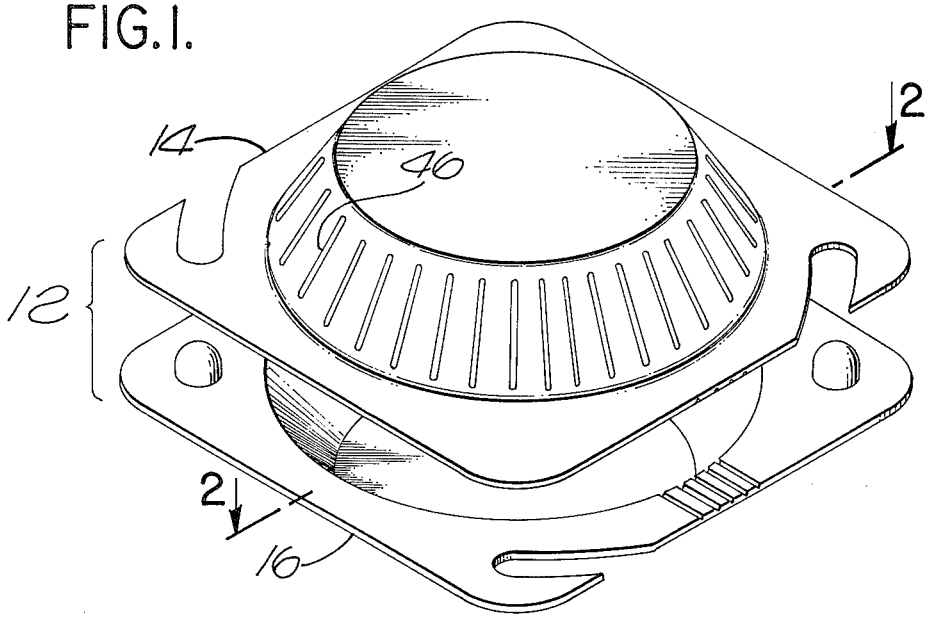
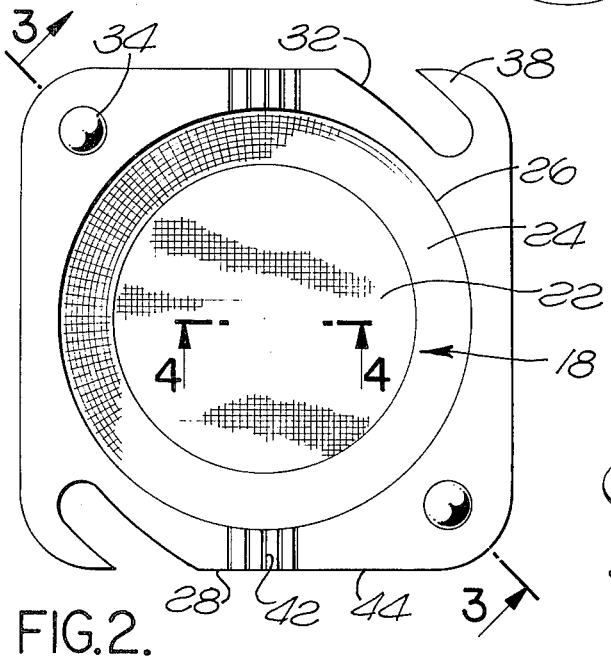
FIG. 2.
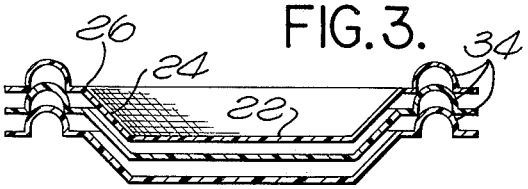
FIG. 3.
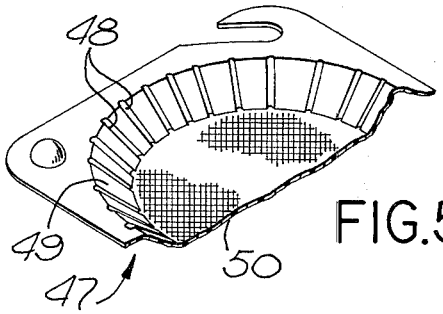
FIG. 5.
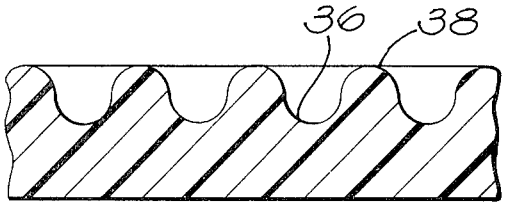
FIG. 4.
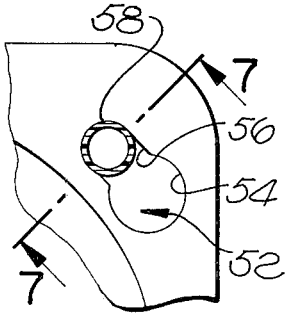
FIG. 6.
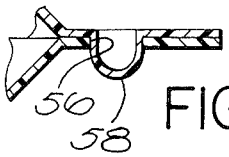
FIG. 7.

INSULATIVE PACKAGING DEVICE

FIELD OF THE INVENTION

The field of art to which the invention pertains includes the field of packaging devices, particularly with respect to insulative packaging devices.

BACKGROUND AND SUMMARY OF THE INVENTION

Conventional hot sandwich containers such as those which form boxes generally require an inordimate amount of time for assembly. Additionally, the boxes are usually formed of cardboard with smooth inner surfaces which do not provide insulation for hot sandwiches. As cold air hits the outside of the box the inner surface of the cardboard cools, resulting in condensation of moisture from the food within the box. The moisture which forms on the inner surface of the box comes into contact with the food, with resultant absorption of the moisture by the bun or bread. In a short period of time, such as 10 or 15 minutes, the bread or bun becomes soggy.

The present invention provides a relatively inexpensive structure which can be easily assembled in a minimum amount of time. The packaging device is made of insulating material and minimizes loss of interior heat and minimizes condensation of moisture on the interior of the package. Any moisture which does form on the interior surface of the packaging device is separated from the bread or bun.

In particular, the packaging device comprises a pair of identical members which, when interconnected, form an insulative food container. Each of the members comprises a dish-shaped portion whose periphery extends as a planar flange. The inner surface of the dish-shaped portion is stipled to define a plurality of protuberances interconnected by a plurality of valleys. Moisture from the food in the package accumulates in the valleys rather than being absorbed by the food.

The advantages of this invention, both as to its construction and mode of operation, will be readily appreciated as the same becomes better understood by reference to the following detailed description when considered in connection with the accompanying drawings in which like reference numerals designate like parts throughout the figures.

BRIEF DESCRIPTION OF THE DRAWINGS

FIG. 1 is a perspective view of a packaging device illustrating the members of the device in an unassembled fashion;

FIG. 2 is a planar view of one of the members of the packaging device;

FIG. 3 is a cross-sectional view of a plurality of members of FIG. 2 taken along the line 3—3 thereof;

FIG. 4 is a cross-sectional view of a portion of one of the members of FIG. 2 taken along the line 4—4 thereof;

FIG. 5 is a partial perspective view, broken away, of alternative surface structure of the inner surface of one of the members of FIG. 1 illustrating in detail the structure of channels provided therein;

FIG. 6 is a partial sectional view illustrating an alternative interconnection arrangement of two members forming a packaging device of the present invention; and FIG. 7 is a partial cross-sectional view of the interconnected members of FIG. 6 taken along line 7—7 thereof.

DESCRIPTION OF THE PREFERRED EMBODIMENTS

Referring to FIG. 1, there is shown a packaging device or container 12 constructed in accordance with principles of the invention. The packaging device comprises a first insulative member 14 and a second insulative member 16. The insulative members 14 and 16 are normally molded from polystyrene foam and are identical in shape enabling an interlocking arrangement to be formed between the members, as will be explained hereinafter.

The insulative member 16, which is shown in planar configuration in FIG. 2, is identical to the insulative member 14 so that only one of the insulative members will be described in detail. The insulative member 16 comprises a circular dish-shaped portion 18 having a lower planar surface 22 and a continuous side wall 24 angularly extending therefrom to a periphery edge 26. A planar flange 28, formed in a plane parallel to the lower planar surface 22, extends outwardly from the periphery edge 26 to define a generally square edge member.

The flange is formed to define a quadrature array of alternating male and female connecting portions. One pair of opposite corners of the planar flange 28 contains curved locking slots 32 which interact with upwardly extending studs 34 formed on a diagonally opposite pair of corners of an adjacent identical dish when the insulating members 14 and 16 are interlocked as illustrated in FIG. 1. As illustrated in FIG. 3, the pitching of the side wall 24 at an angle of about 45°, provides for maximum nesting when stacking the insulating members for storage and shipment and also assures spacing between the flanges sufficient to provide clearance for the upwardly extending studs 34.

The bottom surface 22 and interior surface of the side wall 24 are stippled to define valleys 36 spaced between protuberances 38 in a grid-like network manner. This construction is shown in greater detail in an enlarged cross-section in FIG. 4. To the extent that there is condensation from food stored in the packaging device, the moisture which condenses, will accumulate in the valleys 36. The main purpose of the stippled surface defined by the valleys 36 and the protuberances 38 is to provide a reservoir for water condensed moisture to separate it from the food which rests on the top surface of the protuberances 38. The range of height of the protuberances 38 to the valley 36 could be from 20 to 25 mils. In addition, the number of protuberances per square centimeter should be approximately six; accordingly, the top surface area of each protuberance is less than 0.17 $cm^2$. Other textures can be used which provide hills and valleys. The texture can be obtained during molding by appropriate patterning of the mold surfaces.

Channels 42 are cut into the surface 44 of the planar flange member 28 forming openings into the interior of the dish-shaped portion 18. The channels 42 form a passageway between the edge of the planar flange 28 and the periphery 26 edge of the side walls 24 and provide for moisture escapment along the planar flange surface 44.

Ribs 46 formed on the outer surface of the side wall 24, illustrated in FIG. 1 on the first insulative member 14, provide a gripping surface for securing a pair of insulator members together. As illustrated in FIG. 1, after the food is placed on the lower surface 22 of the bottom insulative member 16, the top insulating member 14 is inverted and placed thereon with the locking slot 32 openings of one of the members positioned adjacent the studs 34 of the adjacent member. The locking slots 32 have a slight taper so that the thickness at the end of the slot is slightly smaller than that of the studs. The container 12 is locked upon rotation of the top member 14 with respect to the bottom member 16. The polystyrene stud is creased by the material defining slot resulting is a securely locked structure, but which can be easily separated when desired.

Referring now to FIG. 5, there is shown an alternative moisture venting arrangement wherein an insulative member 47, which can be similarly shaped as the insulative members 14 and 16 of FIG. 1, is provided with channels 48 formed into the interior surface side wall 49 thereof. The channels 48 further aid in venting moisture from the grid-like lower surface 50 so as to prevent an accumulation of moisture therein.

FIGS. 6 and 7 illustrate an alternative arrangement for the interlocking of stud and slot. In FIGS. 6 and 7 the slots are formed as keyholes 52 having an enlarged aperture 54 interconnected to a reduced width opening 56. Studs 58 from an adjacent insulative member are each inserted into the enlarged aperture 54 of one of the keyholes 52. Rotation of the insulative members with respecto to each other enables the stud 58 to enter the reduced width opening 56 and thus provide a good interlock. Both diagonally opposite slots can have the form shown in FIGS. 6 and 7 or one of the two slots can be so formed while the other slot can have the form of the slot 28 of FIG. 2. The latter arrangement better facilitates alignment of the locking slots and the studs.

I claim:

1. A packaging device comprising a pair of members which, when interconnected, form a substantially closed food container, each of said members being formed from thermally insulative foam material whereby to provide a thermally insulative structure for minimizing loss of interior heat from a hot food item, each of said members comprising a dish-shaped portion having a planar flange formed along the periphery thereof, the interior surface of said dish-shaped portion being textured to define a plurality of protuberances interconnected in a gridlike network by a plurality of valleys so as to enable moisture condensed from hot food placed adjacent said interior surface to accumulate in said valleys, the top surface of each protuberance having an area of less than 0.17 $cm^2$.

2. A packaging device in accordance with claim 1 wherein said pair of members are identical.

3. A packaging device in accordance with claim 1 wherein channels are formed on said planar surfaces for enabling moisture to escape from said closed food compartment.

4. A packaging device in accordance with claim 1 wherein locking means are provided on each of said planar flanges for interlocking said members together and forming a closed food compartment.

5. A packaging device in accordance with claim 4, wherein said locking means comprises studs and locking slots formed in alternation in quadrantal array on said planar surfaces, the studs of one member interacting with the locking slots of the other member to close said packaging device.

6. A packaging device in accordance with claim 5 wherein the diameter of said studs are slightly greater than the width of said slots so as to enable a tight friction fit therebetween.

7. A packaging device in accordance with claim 5 wherein said pair of members are identical.

8. A packaging device comprising first and second members which, when interconnected, form a substantially closed food container, each of said members being formed from thermally insulative foam material whereby to provide a thermally insulative structure for minimizing loss of interior heat from a hot food item, said first member comprising a dish-shaped portion having an interior surface textured to define a plurality of protuberances interconnected into a grid-like network by a plurality of valleys so as to enable moisture condensed from hot food placed adjacent said interior surface to accumulate in said valleys, the top surface of each protuberance being less than 0.17 $cm^2$, the second member being formed to engage the periphery of said first member to close therewith.

9. A packaging device in accordance with claim 8 wherein locking means are provided on each of said members for interlocking said members together and forming a closed food compartment.

10. A packaging device in accordance with claim 8 wherein channels are formed into the material constituting the periphery of said first member for enabling moisture to escape from said closed container.

* * * * *